US006314624B1

(12) United States Patent
Lin

(10) Patent No.: US 6,314,624 B1
(45) Date of Patent: Nov. 13, 2001

(54) SLIDE OF AUTO-LOCK ZIPPER

(76) Inventor: Yu-Pau Lin, 151, Kung Erh Road, Wu Lin Tsuen, Lung Tan Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/471,328

(22) Filed: Dec. 23, 1999

(51) Int. Cl.[7] ..... A44B 19/30
(52) U.S. Cl. ..... 24/421
(58) Field of Search ..... 24/420, 421, 423, 24/424, 425, 418

(56) References Cited

U.S. PATENT DOCUMENTS 3,094,756 * 6/1963 Scheuerman .
3,793,684 * 2/1974 Moertel .
4,074,399 * 2/1978 Kedzierski .
4,081,883 * 4/1978 Ishii et al. .
4,422,220 * 12/1983 Oda .
4,662,036 * 5/1987 Frohlich .
5,896,628 * 4/1999 Oda .

FOREIGN PATENT DOCUMENTS

3342453 * 6/1985 (DE) .
11-127918 * 5/1999 (JP) .

* cited by examiner

*Primary Examiner*—James R. Brittain
(74) *Attorney, Agent, or Firm*—Rosenberg, Klein & Lee

(57) ABSTRACT

A slide of auto-lock zipper comprises a slide, a tab and an elastic plate. The slide main body has two sliding grooves therein and a through hole on top thereof. The tab has a pivotal end at one end thereof such that the tab is pivotally connected to top of the main body. The elastic plate has a fastener; a first bent portion connected to the fastener; a second bent portion connected to the first bent portion; a clamping unit connected to the second bent portion. The second bent portion has a lengthwise slit. The elastic plate is fixed on the top of the main body by the fastener. The second bent portion is located atop the pivotal end. The clamping unit penetrates through the through hole and is inbetween the grooves. The lengthwise slit can enhance the strength of the second bent portion while the thickness of the tab is not increased. Therefore, the slide is not moved unexpectedly when being locked, thus having better dragging strength.

4 Claims, 5 Drawing Sheets

SLIDE OF AUTO-LOCK ZIPPER

FIELD OF THE INVENTION

The present invention relates to a slide of auto-lock zipper, especially to a slide of auto-lock nylon zipper, which enhances dragging endurance of the zipper.

BACKGROUND OF THE INVENTION

The conventional slide of auto-lock zipper comprises a main body, a tab and an elastic plate. The tab is pivotally arranged on the main body and the slide can be operated to open or close the zipper teeth by dragging the tab. The elastic plate is arranged on the main body and has a locking unit penetrating into the main body and lock the zipper teeth. Therefore, the slide is in a locked state when the tab is not dragged. However, the elastic plate has only limited elastic strength. The slide may have unexpected movement by external force even though the slide is locked by the locking unit. In other word, the conventional zipper has poor dragging endurance.

It is the object of the present invention to provide a slide of auto-lock nylon zipper, which enhances dragging endurance of the zipper.

To achieve above object, the inventive slide has a lengthwise slit is provided on the second bent portion of the elastic plate. The lengthwise slit can enhance the strength of the second bent portion while the thickness of the tab is not increased. Therefore, the slide is not moved unexpectedly when being locked, thus having better dragging strength.

The various objects and advantages of the present invention will be more readily understood from the following detailed description when read in conjunction with the appended drawing, in which:

DETAILED DESCRIPTION OF THE PREFERRED EMBODIMENT

Figure 1:
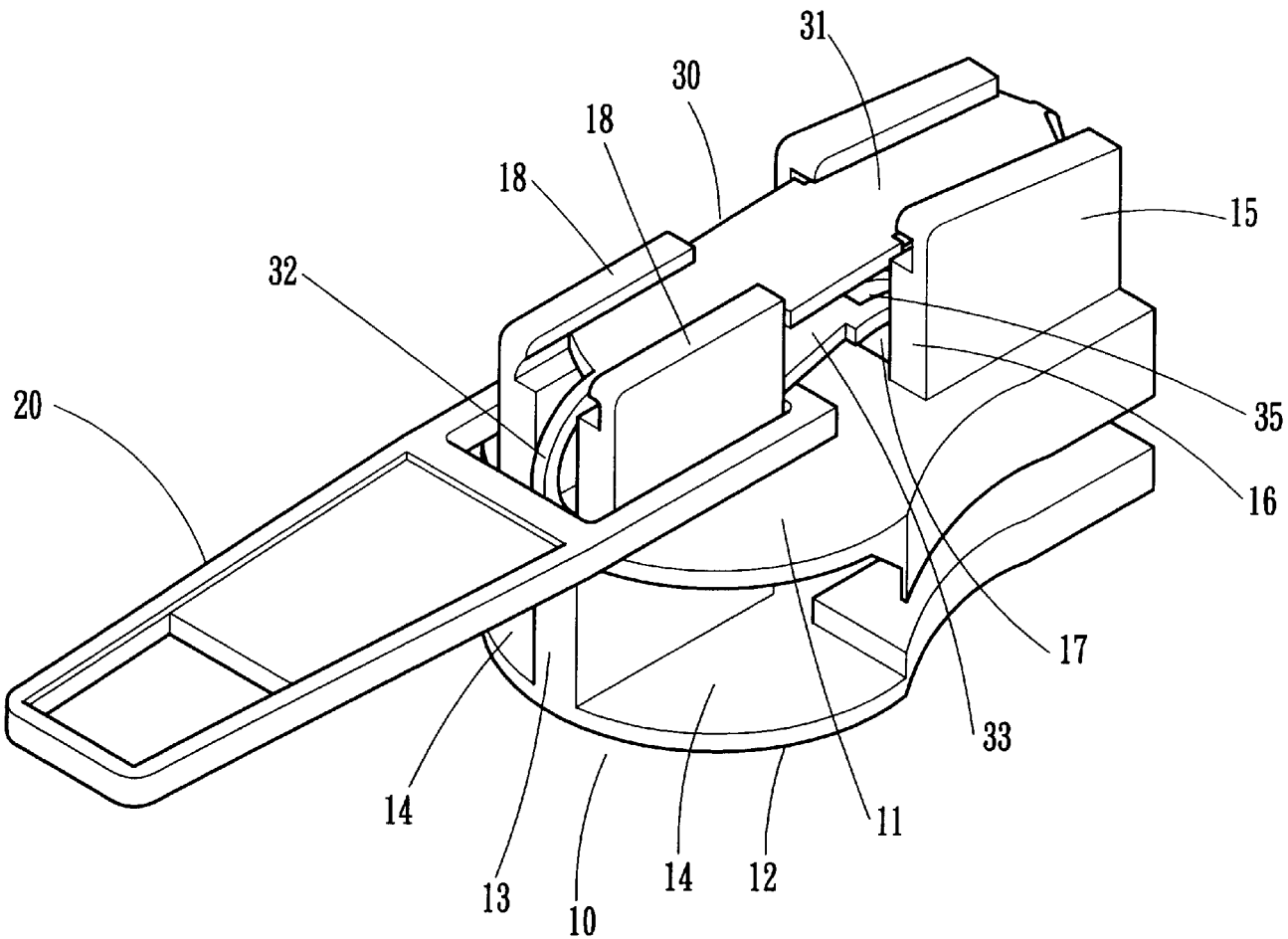
FIG. 1 is the perspective view of present invention.
Figure 2:
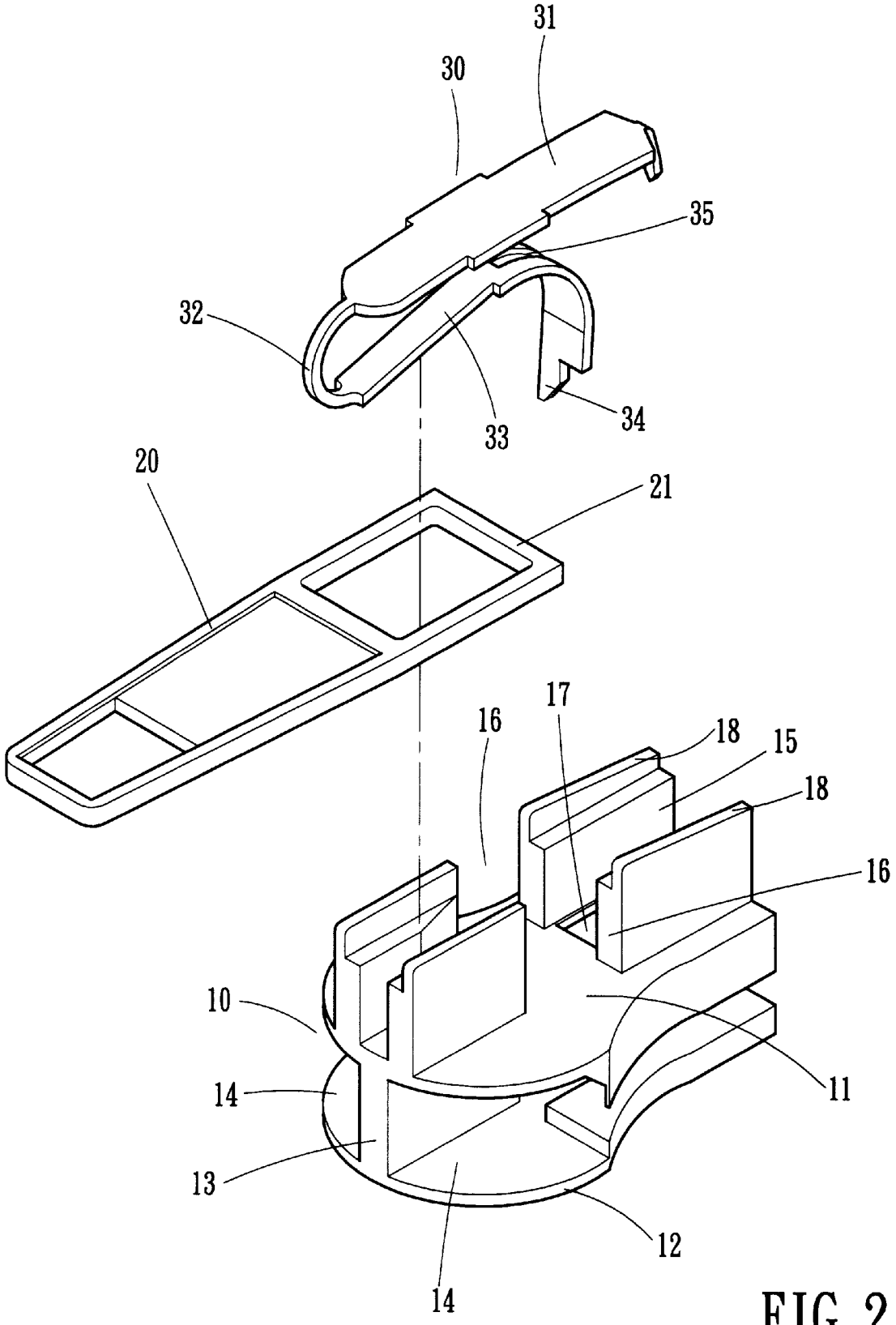
FIG. 2 is the exploded view of the present invention.

As shown in FIGS. 1 to 4, the present invention is intended to provide a slide of auto-lock nylon zipper, which enhances dragging endurance of the zipper. The slide according to the present invention comprises a main body 10, a tab 20 and an elastic plate 30. The main body 10 has a top plate 11 and a bottom plate 12 with a predetermined distance and bridged integrally by a bridging plate 13. Two sliding grooves 14 are formed between the top plate 11 and the bottom plate 12 and located on two lateral sides of the bridging plate 13 to accommodate the teeth of the zipper. The top plate 11 of the main body 10 has two pivotal stages 15 extended along lengthwise direction on top side thereof and each having a indent pivotal groove 16. The pivotal stages 15 each has a retainer 18 on top side thereof. The top plate 11 has a through hole 17 between two pivotal stages 15.

The tab 20 is a lengthwise plate with one end being a pivotal end 21 pivotally arranged within the indent pivotal groove 16 such that the tab 20 is pivotally connected to top of the main body 10.

The elastic plate 30 is made of material with good elasticity and has a fastener 31. A thinner first bent portion 32 is extended from one end of the fastener 31 to provide larger elasticity. A second bent portion 33 is extended from the first bent portion 32 and located below the fastener 31. The second bent portion 33 is connected with a clamping unit 34 at another end thereof and has a lengthwise slit 35. The elastic plate 30 is arranged between two pivotal stages 15 and the two retainers 18 are folded inward to lay on the both sides of the fastener 31 and clamp the fastener 31. Therefore, the elastic plate 30 is retained between two pivotal stages 15 on top of the main body 10. Moreover, the second bent portion 33 is located upon the pivotal end 21 of the tab 20 and the clamping unit 34 of the elastic plate 30 penetrates through the through hole 17 on top of the main body 10 and extends into a location between two sliding grooves 14, thus clamping the teeth.

Figure 3:
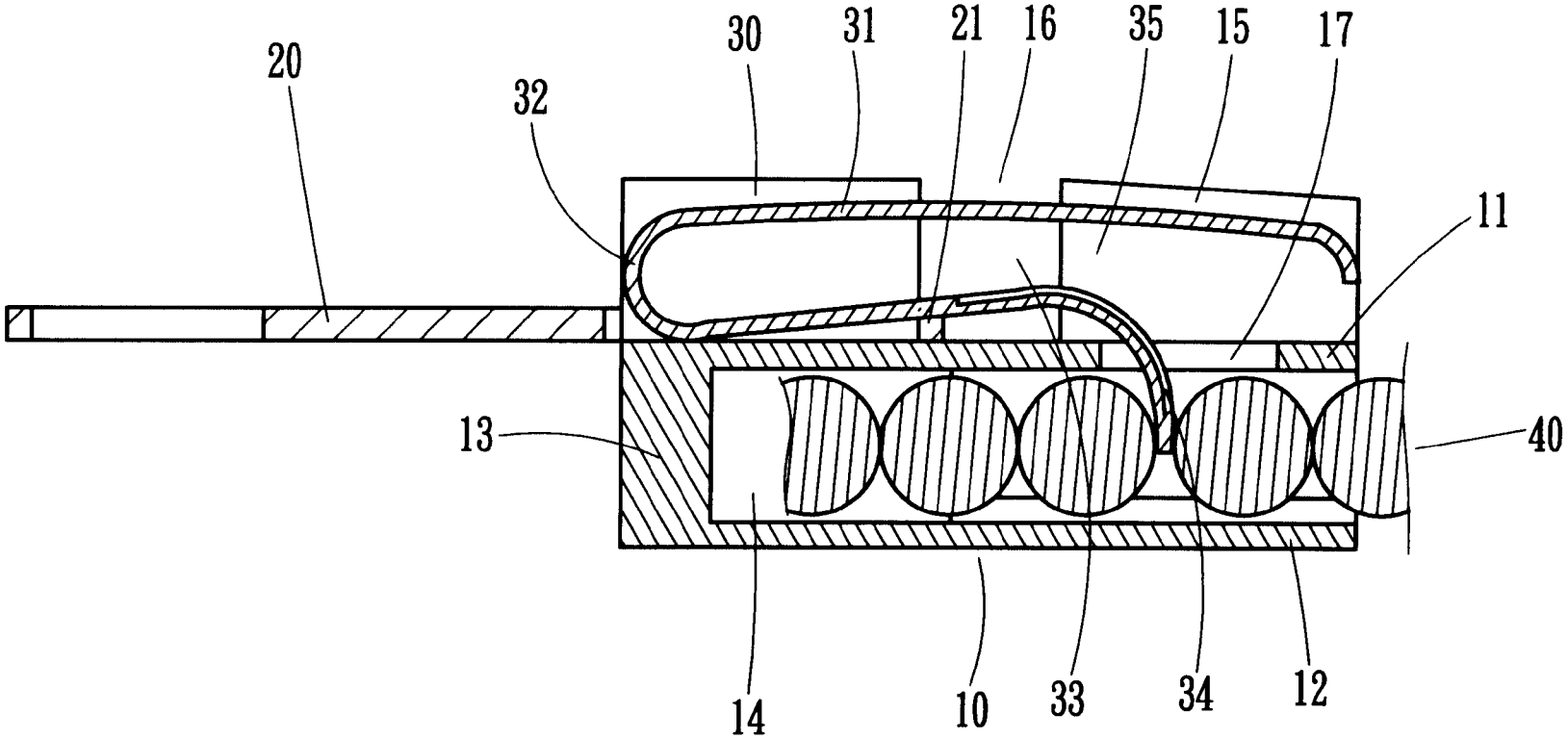
FIG. 3 is the sectional view of the present invention.
Figure 4:
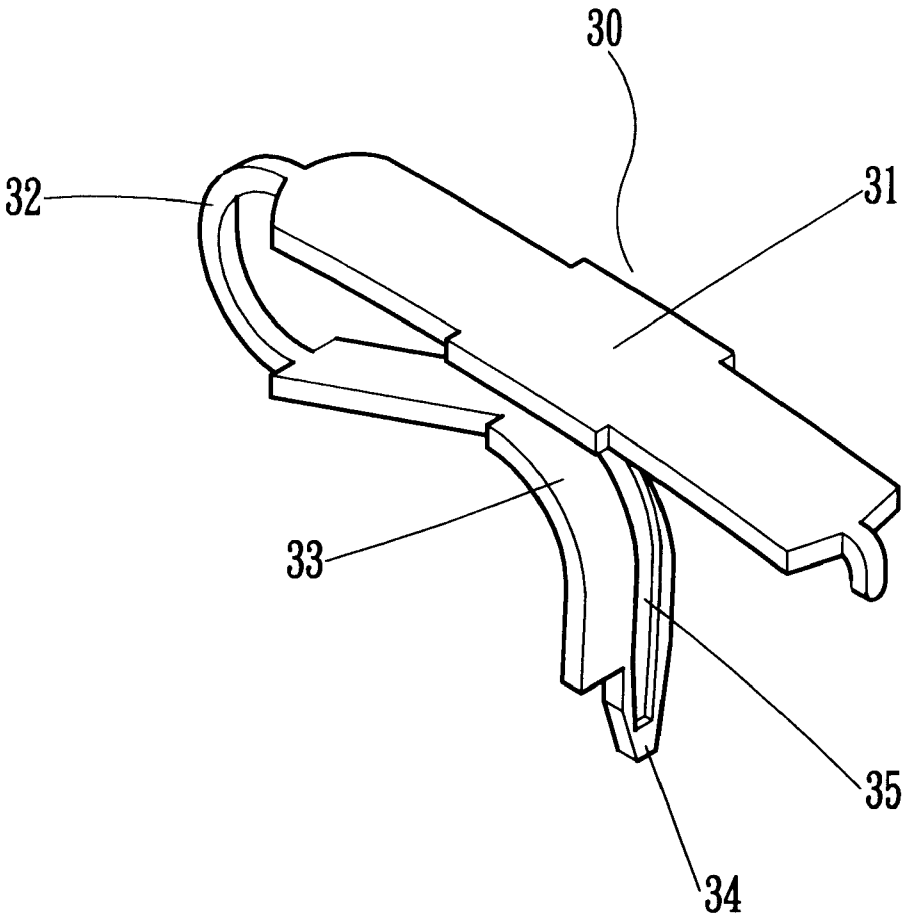
FIG. 4 is the perspective view of the elastic plate of the present invention from another view angle.
Figure 5:
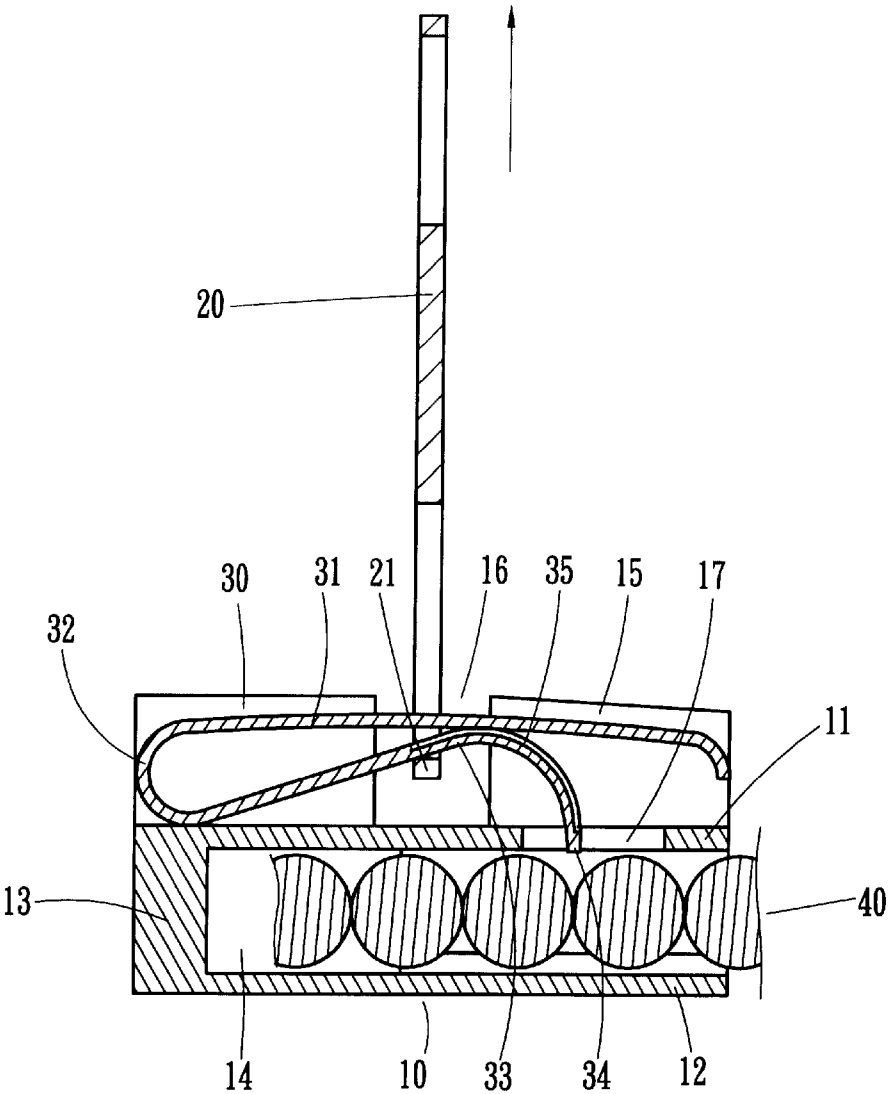
FIG. 5 shows the use of the present invention.

As shown in FIGS. 3 and 5, the slide is assembled on the teeth 40 through the two sliding grooves 14 of the main body 10 and the tab 20 can be operated to close or open the teeth 40. As shown in FIG. 5, when the tab 20 is dragged, the pivotal end 21 of the tab 20 pushes upward the second bent portion 33 of the elastic plate 30 and the clamping unit 34 at distal end of the second bent portion 33 is driven to move upward and detach from the teeth 40. Therefore, the slide can be smoothly moved upward and downward by dragging the tab to open and close the teeth 40. As shown in FIG. 3, when the tab 20 is released, the pivotal end 21 of the tab 20 no longer pushes upward the second bent portion 33 of the elastic plate 30. The clamping unit 34 at distal end of the second bent portion 33 return to clamp the teeth 40 such that the teeth 40 is in a locked state.

The present invention is characterized in that a lengthwise slit 35 is provided on the second bent portion 33 of the elastic plate 30.The lengthwise slit 35 can enhance the strength of the second bent portion 33 while the thickness of the tab 30 is not increased. Therefore, the slide is not moved unexpectedly when being locked, thus having better dragging strength.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An automatically locking slide for a zipper comprising:

(a) a main body having top and bottom plates defining therebetween a pair of longitudinally extended sliding grooves, said top plate having a through hole formed therein;

(b) a tab coupled in substantially pivotal manner to said main body, said tab being displaceable about a pivotal end portion thereof responsive to user actuation;

(c) an elastic plate coupled to said main body, said elastic plate retentively engaging said pivotal end portion of said tab, said elastic plate including a longitudinally extended fastener portion, a longitudinally extended distal bent portion, and an arcuate proximal bent portion extending integrally therebetween, said fastener portion being spaced from and extending at least partially over said distal bent portion, said distal bent portion having an arcuate section terminating at a clamping unit, said arcuate section having a first surface and a second planar surface thereof, and a lengthwise groove formed at said first surface of said arcuate section, and extending within the thickness of said arcuate section defined between said first surface and said second planar surface thereof and along substantially the whole length of said arcuate section;

said elastic plate being elastically biased to a first configuration, whereby said clamping unit thereof extends through said top plate through said through hole of said main body into at least one said sliding groove, said elastic plate being deflectable responsive to user actuation of said tab to a second configuration, whereby said distal bent portion is displaced relative to said fastener to substantially withdraw said clamping unit from said sliding groove of said main body.

2. The automatically locking slide as recited in claim 1 wherein said main body includes a bridging plate extending between said top and bottom plates, said bridging plate separating said sliding grooves.

3. The automatically locking slide as recited in claim 1 wherein said main body includes a pair of opposed longitudinally extended pivotal stages for retaining said elastic plate therebetween, said pivotal stages cooperatively defining a transverse pivotal groove portion receiving said pivotal end portion of said tab.

4. The automatically locking slide as recited in claim 3 wherein said main body includes at least one retainer projecting transversely from each of said pivotal stages, said retainers clamping said elastic plate fastener portion against said pivotal stages.

* * * * *